US012024333B2

(12) United States Patent
Dent

(10) Patent No.: US 12,024,333 B2
(45) Date of Patent: Jul. 2, 2024

(54) CONTAINER HAVING A BLOCKABLE ARTICULATION DEVICE

(71) Applicant: Schoeller Allibert GmbH, Schwerin (DE)

(72) Inventor: Matthew David Dent, Northwich (GB)

(73) Assignee: Schoeller Allibert GmbH, Schwerin (DE)

( * ) Notice: Subject to any disclaimer, the term of this patent is extended or adjusted under 35 U.S.C. 154(b) by 77 days.

(21) Appl. No.: 17/873,543

(22) Filed: Jul. 26, 2022

(65) Prior Publication Data

US 2023/0041902 A1 Feb. 9, 2023

(30) Foreign Application Priority Data

Aug. 9, 2021 (EP) ..... 21190317

(51) Int. Cl.
*B65D 19/06* (2006.01)

(52) U.S. Cl.
CPC .... *B65D 19/06* (2013.01); *B65D 2519/00273* (2013.01); *B65D 2519/00572* (2013.01)

(58) Field of Classification Search
CPC ..... B65D 19/06; B65D 2519/00273; B65D 2519/00572; B65D 2519/00034; B65D 2519/00069; B65D 2519/00174; B65D 2519/00333; B65D 2519/00502; B65D 2519/00805; B65D 2519/00975; B65D 25/005; B65D 19/18; E05D 3/12; E05D 3/18; E05D 11/06; E05D 11/10; E05Y 2900/602
See application file for complete search history.

(56) References Cited

U.S. PATENT DOCUMENTS 4,192,430 A * 3/1980 Cornou ..... B65D 19/18 220/817
4,662,532 A 5/1987 Anderson et al.
5,558,241 A * 9/1996 Huffstutler, Jr. ... B65D 11/1833 220/4.31

(Continued)

FOREIGN PATENT DOCUMENTS

CN 102582912 B 7/2014
CN 112854932 A 5/2021

(Continued)

OTHER PUBLICATIONS

Search Report received in European Application No. 21190317.4, dated Jan. 17, 2022, 9 pages.

(Continued)

*Primary Examiner* — Shawn M Braden
(74) *Attorney, Agent, or Firm* — Christopher A. Rothe; Culhane PLLC

(57) ABSTRACT

A container includes a first container portion, a second container portion, and an articulation device connecting the first container portion to the second container portion to be pivotable around a first hinge axis. The articulation device includes a sliding joint, which allows a sliding of the first container portion relative to the second container portion transverse to the first hinge axis. A blocking element is movable from a blocking position, which blocks the sliding joint against a spring force, to an unblocking position, which unblocks the sliding joint by an actuation of the sliding joint.

17 Claims, 5 Drawing Sheets

(56) References Cited

U.S. PATENT DOCUMENTS

| | | | | |
|---|---|---|---|---|
| 7,331,480 | B1 | 2/2008 | Nolan | |
| 2008/0142530 | A1* | 6/2008 | Meers | B65D 21/0233 220/666 |
| 2009/0057320 | A1* | 3/2009 | Meers | B65D 25/005 220/660 |
| 2017/0074017 | A1* | 3/2017 | Ficker | B65D 19/18 |
| 2020/0122885 | A1 | 4/2020 | Dent | |

FOREIGN PATENT DOCUMENTS

| | | | | | |
|---|---|---|---|---|---|
| DE | 102017113053 | A1 | | 12/2018 | |
| EP | 3141492 | A1 | | 3/2017 | |
| GB | 2357078 | A | * | 6/2001 | B65D 11/1833 |
| JP | H0628156 | U | | 4/1994 | |

OTHER PUBLICATIONS

Communication received in European Application No. 21 190 317.4-1014 dated Dec. 6, 2023, 4 pages.

* cited by examiner

CONTAINER HAVING A BLOCKABLE ARTICULATION DEVICE

CROSS-REFERENCE TO RELATED APPLICATION

This application claims priority to European Application No. 21 190 317.4, filed Aug. 9, 2021, the content of which is incorporated by reference herein in its entirety.

FIELD

The present disclosure relates to a container having a first container portion, a second container portion, and an articulation device connecting the first container portion to the second container portion to be pivotable around a first hinge axis.

BACKGROUND

Containers often have portions which have to be pivoted with respect to each other, such as foldable side walls, doors or lids, which need to be handled in a simple, fast and secure manner.

One example for such containers is heavy load carriers which serve to receive in particular unit products and the like, and are used in the non-food field, in industry, and specifically preferably in the automotive sector. These heavy load carriers are dependent on a construction, which is lightweight but still stable in view of the amount of unit products to be received, and also on simple handling when folding up the side walls, if the heavy load carriers are emptied, so as to make simple, compact return transport possible. For easier withdrawal of the products received in the heavy load carrier, the side walls or at least one side wall are provided with a door or flap which can be folded down outwards, the flap being positioned against the outer face of the corresponding side wall in the folded-down position.

CN 102 582 912 B discloses a container comprising a bottom and a side wall, wherein one or more of the side walls are provided with a side door, the side door and the side wall being connected by a hinge arrangement. The container further comprises a hands-free side door closing device so that the side door can be closed without lifting the door or without being lowered by the side door. The hands-free side door closing device comprises a ramp structure on either the side wall, the side door or the hinge device, and a sliding member matched with the slope structure and arranged on any one of the side wall, the side door and the hinge device so that, in the closing process of the side door, the side door can be lifted along the slope structure. However, in this prior art, a relatively high number of parts is necessary, which, in parts, have fragile structures which may be expensive to manufacture and to assemble. Further, such structures may be damaged easily if there are instabilities in a closing and locking process. Parts having such structures may be difficult and/or expensive to exchange.

Further prior art can be found in DE 10 2017 113 053 A1 which discloses a large load carrier with a bottom, four circumferentially arranged side walls and at least one flap in a side wall which is folded outwards, wherein a positive guide for a translational movement of the flap is provided when pivoting the flap.

SUMMARY

In view of the above described problems it is an object of the present disclosure to provide a container which solves problems of the prior art. In particular, it is an object to provide a container having two portions, which can be pivoted with respect to each other and locked in a simple, secure and/or fast manner.

The object underlying the present disclosure is solved by a container and a articulation device, respectively as described herein.

In particular, the object is solved by a container having a first container portion, a second container portion, and a articulation device connecting the first container portion to the second container portion to be pivotable around a first hinge axis and comprising a sliding joint, which allows a sliding of the second container portion relative to the first container portion transverse to the first hinge axis, and a blocking element, which is movable from a blocking position, blocking the sliding joint, against a spring force to an unblocking position, unblocking the sliding joint, by an actuation of said sliding joint.

Expressed in other words, a container has two portions, which are connected to be both pivotable and translatable with respect to each other, wherein an interference or blocking element is provided which is biased to interfere with or block the translatability.

In particular, the sliding joint is operable independently from a pivoting movement of the first container portion relative to the second container portion. In other words, the two container portions (i.e. the first container portion and the second container portion) may pivot relative to each other without sliding relative to each other. Further, the two container portions may slide relative to each other via the sliding joint without pivoting relative to each other.

Moreover, in detail, unblocking the blocking element may be effected by forcing an operation of the sliding joint, i.e. by applying at least a predetermined force to one of the two container portions in a sliding direction of the sliding joint, in particular when the two container portions are in a predefined position relative to each other, further in particular parallel or aligned/in one plane with each other. Then, one of the two container portions may press against the blocking element to overcome the spring force and to push the blocking element out of the blocking position. Preferably, the blocking element in the blocking element is arranged in or protrudes into a sliding path of the sliding joint (e.g. in or into a guiding groove in which a pin may slide as described as an example below).

Preferably, the blocking element is formed as a separate member, in particular separately from all other elements of the container. The blocking element may be exchangeable as a separate unit, particularly in a non-destructible manner. I.e. the blocking element is loosely held in the articulation device. Since the blocking element may be under a lot of strain, the blocking element can advantageously be provided as a spare part and is easily exchangeable. Moreover, existing containers can easily be retrofitted with the blocking element.

Preferably, the container may have a bottom portion and at least one (preferably four) side wall(s) extending upwards with respect to the bottom portion. The first container portion may be a bottom wall or a side wall of the container. The second container portion may be a door or a flap. The hinge axis may be defined by a centre axis of a hinge pin or the like. Preferably, the second container portion is pivoted towards an outer side of the container.

Further preferably, the sliding joint is provided via a longitudinal guiding element such as a guide groove or rail and an slider such as a pin or bracket or wheel guided along said guiding element, optionally engaging it. Preferably, the guiding element is provided in the first or second container portion. In this manner, a clearly defined sliding path is provided for the actuation of the sliding joint. Actuation of the sliding joint means that the function of the sliding joint is used and the second container portion is translated relative to the first container portion transverse to the first hinge axis. Blocking of the sliding joint means that the sliding joint essentially cannot be actuated while the blocking element is in the blocking position. If the sliding joint is blocked by the blocking element, the spring force has to be overcome to push the blocking element into the unblocking position. The blocking element may engage directly with a component of the sliding joint or may contact/engage the first container portion and/or the second container portion to block the sliding joint. Advantageously, an operator may handle the container without a danger of instabilities in the interaction between the first and second container portions. In particular, the sliding joint can only be actuated purposefully and cannot slip in an uncontrolled manner during handling.

In particular, the second container portion may be slidable relative to the first container portion via the sliding joint from a first sliding position, where the sliding joint is (maximally) extended to provide a (maximum) distance between the first container portion and the second container portion (measured along the articulating device), to a second sliding position, where the sliding joint is (maximally) retracted to reduce (minimize) the distance between the first container portion and the second container portion (measured along the articulating device). Corresponding maximum and minimum distances may be defined by stops formed at end portions of the sliding joint.

Preferably, the first hinge axis is essentially parallel to the bottom wall of the container. Expressed in other words, the second container portion is pivotable upwards (i.e. away from the bottom wall) and downwards (i.e. towards the bottom wall). In this case, providing the blocking element is particularly advantageous, since the sliding joint cannot be activated accidentally by gravity.

Preferably, the container may comprise an opening, particular a lateral opening formed in the side wall of the container. Further, the second container portion may be pivotable to a closing position, in which the second container portion covers or closes the opening, e.g. forming a door or flap. Preferably, the first hinge axis extends along a lower rim portion of the opening (i.e. a rim at a side of the opening which faces/is nearest to the bottom portion) and in the closing position, the second container portion is pivoted upwards. Further, the second container portion may be pivotable to a fully opened position, wherein the second container portion is pivoted away from the closing position, preferably pivoted to an opposing stop, e.g. abutting the first container portion. Preferable, a rim portion of the opening forms a stop with the second container portion, such that it cannot pivot further than the closing position.

Further preferably, the first container portion, particularly a rim portion of the opening, has a first engagement portion and the second container portion has a second engagement portion, particularly at an outer periphery thereof. The first and second engagement portions are configured to engage or disengage with each other by actuating the sliding joint when the second container portion is in the closing position. Expressed in other words, the first and second container portions may form a locking structure for locking the first and second container portions in the closing position, said locking structure being actuated via the sliding joint. In this manner, a secure and simple way of locking the first and second container portions is provided. If the first and second container portions form a stop to limit the pivoting of the second container portion, the second engagement portion may be guided between said stop and the first engagement portion such that a pivoting of the second container portion is prevented during actuation of the sliding joint.

Further preferably, an upper rim of the second container portion and preferably the first container portion may form a stacking rim, preferably being in alignment when the first and second container portions are in the closed position and locked. Thus, a corresponding second container stacked on top of the container of the present disclosure and engaging with the stacking rim will serve as an additional locking means for locking the second container portion with respect to the first container portion.

It is further preferable, that the articulation device comprises an intermediate element which is connected to the first container portion to be rotatable around the first hinge axis and which is further connected to the second container portion to be rotatable around a second hinge axis. Expressed in other words, the two container portions may be pivotable relative to each other around two hinge axis (i.e. the first hinge axis and the second hinge axis), preferably around exactly two hinge axis. The first and second hinge axis are preferably parallel to each other. Advantageously, the second hinge axis can be pivoted away from the container wall, particularly towards a container outside. This allows the second container portion to pivot more freely and the opening is better accessible. Preferably, a distance provided by the intermediate element between the first and second hinge axis corresponds at least to a first distance between a position of the first hinge axis in the first container portion and an outer surface of the first container portion added to a second distance between a position of the second hinge axis in the second container portion and an outer surface of the second container portion. In this case, the second container portion can be pivoted to be parallel with the first container portion in the fully opened position, thus providing maximum accessibility. Preferably, the intermediate member integrally forms or is fixedly connected to the hinge pins which define the first and second hinge axis. Alternatively, the intermediate member may provide a first and/or a second hinge eye for receiving the hinge pins, which are integrally formed or are fixedly connected to the first and/or second container portions, respectively. The first and/or second hinge pin may further be accommodated in the (one or more) guiding groove(s) of the sliding joint, forming a portion of the sliding joint.

Further, it may be advantageous if the blocking element is accommodated in a recess or pocket within the articulation device, such that the blocking element is adapted to protrude from said recess (in particular in a direction parallel to the first and/or second hinge axis) in the blocking position to block the sliding joint. Further, the blocking element may be adapted to be pushed further into the recess to reach the unblocking position. In particular, the recess extends parallel to the first and second hinge axis and the blocking element may moved between he blocking position and the unblocking position in a direction parallel to the first and second hinge axis. The blocking element may be guided by lateral walls of the recess. The blocking element is preferably held loosely within said recess, such that it may move into and out of the recess. In this case, the blocking element is protected from damage via the recess walls. Preferably, the recess is provided within the intermediate element, further preferably between the first hinge axis and the second hinge axis. This is advantageous with regard to constructional space. Further, for adapting the intermediate element to receive the blocking element, only a small tool has to be provided, which is cost-effective compared to an adaptation of e.g. a container wall or door.

According a preferred aspect, the first container portion forms a first contact rim adapted to contact the blocking element and facing the articulation device and the second container portion. Further preferred, the second container forms a second contact rim adapted to contact the blocking element and facing the articulation device and the first container portion.

Preferably, the blocking element has a protruding or blocking end portion for blocking the sliding joint and/or for protruding from the recess. The blocking end portion is preferably formed as a nub or cylinder portion having a rounded (oval or circular) outer circumferential surface facing radially outwards with respect to a protruding direction of the blocking element (i.e. a moving axis defining a moving direction of the blocking element, when said blocking element moves between the blocking position and the unblocking position). Due to this, the first and/or second container portion (the first and/or second contact rims) may roll off against the rounded outer circumferential surface of the blocking end portion when the blocking element is (at least partially) in the blocking position. The blocking end portion may form a front surface facing in the protruding direction, which is preferably flat and parallel to an outer surface in which the recess opens. Thus, it the blocking end portion is adapted to the narrow space between members of the articulation device.

Further, the blocking element may have a spring portion providing the spring force. Particularly advantageously, the spring portion and the protruding or blocking end portion are formed integrally with each other, preferably injection molded. As such, manufacture of the blocking element is cost-effective and handling and assembly thereof are simple. An inner end of the blocking element may be dimensioned to be fitted into the recess.

Preferably, the protruding or blocking end portion is smaller than an opening of the recess. A collar having the same shape as the opening of the recess may be formed surrounding the blocking end portion. Thus, the blocking end portion can be dimensioned in accordance with dimensions of rest of the articulation device while the collar provides protection against dust entering the recess, which would increase a risk of damaging the blocking element.

Preferably, by actuating the sliding joint when the blocking element is in the blocking position, the second container portion and/or the first container portion (in particular the first and/or second contact rims) is/are pressed against the blocking element and push/es said blocking element into the unblocking position. This allows a particularly simple method of handling the container, since the user does not have to change his grip or need a second hand for unblocking the sliding joint.

In particular, an inclined surface may be provided at a contact area where the blocking element contacts the first container portion and/or the second container portion, such that a force acting on the blocking element in the sliding direction of the sliding joint due to a pressure of the first container portion and/or the second container portion is redirected via the inclined surface to push the blocking element into the unblocking position. If e.g. the sliding joint is formed by the second container portion and the intermediate element, the second container portion (the second contact rim) may be pressed in a direction transverse to the first hinge axis against an the inclined surface formed at the protruding or blocking end portion of the blocking element (i.e. a portion protruding from the recess in the blocking position). Due to this, the second container portion displaces the blocking element in a direction parallel to the first hinge axis, pushing the blocking element into the recess into the unblocking position. This is a particularly simple and smoothly operable mechanism for unblocking the sliding joint.

Alternatively or additionally, the protruding or blocking end portion of the blocking element may be elastic and may further be dimensioned such that, during actuation of the sliding joint to lock the first and second container portions, the protruding or blocking end portion of the blocking element is squeezed between the first contact rim and the second contact rim such that the blocking element (particularly the protruding or blocking end portion) evades the resulting pressure by moving into the recess.

It can be advantageous if the first container portion has (at the first contact rim) a first edge portion having a first blocking part and a first unblocking part, with the first unblocking part (may include a corner or protrusion) extending further radially outwards with respect to the first hinge axis than the first unblocking part. The first blocking and unblocking parts are preferably adjacent to each other in a circumferential direction with respect to the first hinge axis. The blocking element is preferably maintained pushed into the recess by the first unblocking part of the first edge portion of the first container portion, when the second container portion is in the fully opened position. Expressed in other words, viewed in the extending direction of the first hinge axis, the first unblocking part of the first edge portion may overlap the blocking element in fully opened position.

Further preferably, when the intermediate element of the articulation device is rotated towards the closing position around the first hinge axis, the blocking element is at least partially released due to the unblocking part or the first edge portion moving away (removed from the position overlapping the blocking element) from the blocking element. Said blocking element may then protrude from the recess. In particular, the first blocking part is then arranged between the hinge axis and the blocking element or blocking end portion, such that the blocking element is not overlapped in its protruding direction. In particular, the blocking element and the first edge portion are dimensioned such that the blocking element is released when the intermediate element, and preferably the second container portion, has an angular distance of 2° to 60°, further preferably 2° to 45°, further preferably 2° to 20°, further preferably 5° to 10°, with respect to the closing position. In this manner, the blocking element protruding adjacent to the first container portion may serve as an obstacle or a support for maintaining a position of the intermediate element and the second container portion, particularly keeping them from falling. Thus, a strain on a hinged connection between the first container portion and the intermediate element is reduced and the user needs less strength for holding the second container portion, when the blocking element is released by the first edge portion.

It may further be of advantage, if the second container portion has (at the second contact rim) a second edge portion having a second blocking part and a second unblocking part, with the second unblocking part (may include a corner or a protrusion) extending further radially outwards with respect to the second hinge axis than the second blocking part region. These second blocking and unblocking parts are preferably adjacent to each other in a circumferential direction with respect to the second hinge axis. The blocking element is preferably maintained pushed into the recess by the second unblocking part of the second edge portion, when the second container portion is a fully opened position. Expressed in other words, viewed in the extending direction of the second hinge axis, the second unblocking part of the second edge portion may overlap the blocking element in the fully opened position.

Advantageously, when the second container portion is pivoted towards the closing position (e.g. upwards) around the second hinge axis, the unblocking part of the second edge portion is pivoted away (removed from the position overlapping the blocking element) from the blocking element, such that said blocking element is at least partially released to protrude from the recess. In particular, the first blocking part is then arranged between the hinge axis and the blocking element or blocking end portion, such that the blocking element is not overlapped in its protruding direction. In particular, the blocking element and the second edge portion are dimensioned such that the blocking element is released when the second container portion or the intermediate element has an angular distance of 2° to 60°, further preferably 2° to 45°, further preferably 2° to 20°, further preferably 5° to 10°, with respect to a position where the intermediate member and the second container portion are aligned according to their relative positions in the closing position, preferably in a position where the second container portion is rotated halfway (+/−10%) between the fully opened position and the closing position. In this manner, the blocking element may block the sliding joint such that a distance between the first and second container portions is maintained when the second container portion and the intermediate member are further pivoted (upwards) around the second hinge axis. Additionally, the blocking element protruding next to the second container portion may serve as an obstacle or a support for the second container portion. Thus, a strain on a hinged connection between the intermediate element and the second container portion is reduced and the user needs less strength for holding said second container portion.

In other words and in particular, at the intermediate element, a distance between the first hinge pin (or hinge eye) and the blocking end portion may be equal to or larger than a distance between the first hinge eye (or hinge pin) and the first blocking part of the first container portion. I.e., the first blocking part may be dimensioned such that it is insertable between the first hinge pin and the blocking end portion of the blocking element. Preferably, the first unblocking portion and the first blocking portion are orthogonal to each other. Further, at the intermediate element, a distance between the first hinge pin (or hinge eye) and the blocking end portion may be equal to or smaller than a distance between the first hinge eye (or hinge pin) and the first unblocking part of the first container portion. I.e., the first unblocking part may be dimensioned such that it is not insertable between the first hinge pin and the blocking end portion of the blocking element. Thus, the first unblocking part is adapted to overlap the blocking end portion.

In other words and in particular, at the intermediate element, a distance between the second hinge pin (or hinge eye) and the blocking end portion may be equal to or larger than a distance between the second hinge eye (or hinge pin) and the second blocking part of the second container portion. I.e., the second blocking part may be dimensioned such that it is insertable between the second hinge pin and the blocking end portion of the blocking element. Preferably, the second unblocking portion and the second blocking portion are orthogonal to each other. Further, at the intermediate element, a distance between the second hinge pin (or hinge eye) and the blocking end portion may be equal to or smaller than a distance between the second hinge eye (or hinge pin) and the second unblocking part of the first container portion. I.e., the second unblocking part may be dimensioned such that it is not insertable between the second hinge pin and the blocking end portion of the blocking element. Thus, the second unblocking part is adapted to overlap the blocking end portion.

Preferably, the recess opens in a surface of the intermediate element and the blocking element is arranged in the recess to be tiltable relative to said surface of the intermediate element. Thus, the blocking element may have one portion being pushed into the recess against the spring force by one of the first and second container portions while a second portion of the blocking element is pushed out of the recess by the spring force, engaging the other one of the first and second container portions. In particular, the second portion is pushed out of the recess by the spring force when the other one of the first and second container portions moves out of the way with respect to the moving direction of the blocking element. The spring portion may be bendable. Due to this, the sliding joint can be blocked when the second container portion and the intermediate element are pivoted around the first hinge axis, whereas additional support of the intermediate element and the second container portion is provided later. Further, this effect can be achieved by a single blocking element, which is cost-effective and easily assembled.

Further preferably, the second container portion, particularly the second engagement portion, forms a stop with the articulation device, particularly with the intermediate element, and/or with the first container portion. Said stop may limit a pivoting of the second container portion around the second hinge axis towards the closing position. In particular, a wall portion of the second container portion extends towards the articulation device, such that said wall portion contacts the articulation device and/or the first container portion to limit the pivoting of the second container portion. Advantageously, the second engagement portion of the second container portion may function as the wall portion of the second container portion, said wall portion also serving as the stop for limiting the pivoting of the second container portion. This provides a particularly simple structure.

Alternatively or additionally, the object underlying the intention is solved by a articulation device for an above-described container comprising a first hinge axis, adapted to provide a pivotable connection of a first container portion to a second container portion, a sliding joint, which allows a sliding of the second container portion relative to the first container portion transverse to the first hinge axis, and a blocking element, which is movable from a blocking position, blocking the sliding joint, against a spring force to an unblocking position, unblocking the sliding joint, by an actuation of said sliding joint

BRIEF DESCRIPTION OF THE DRAWING FIGURES

The following figures illustrate an exemplary embodiment of the disclosure. The disclosure is not limited to the embodiment described below. Other embodiments, combinations of embodiments and modifications may be provided within the scope of this disclosure.

DETAILED DESCRIPTION

Figure 2:
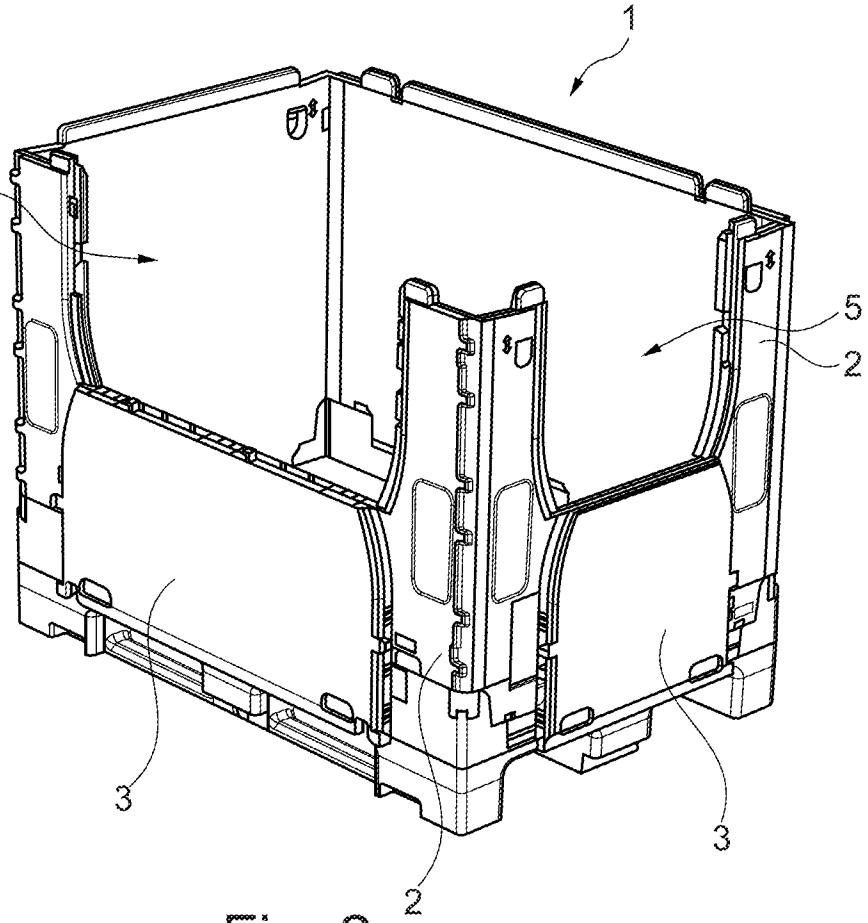
FIGS. 1 and 2 show a container according to a preferred embodiment of the disclosure, respectively with a door in a closing position and in a fully opened position.
Figure 1:
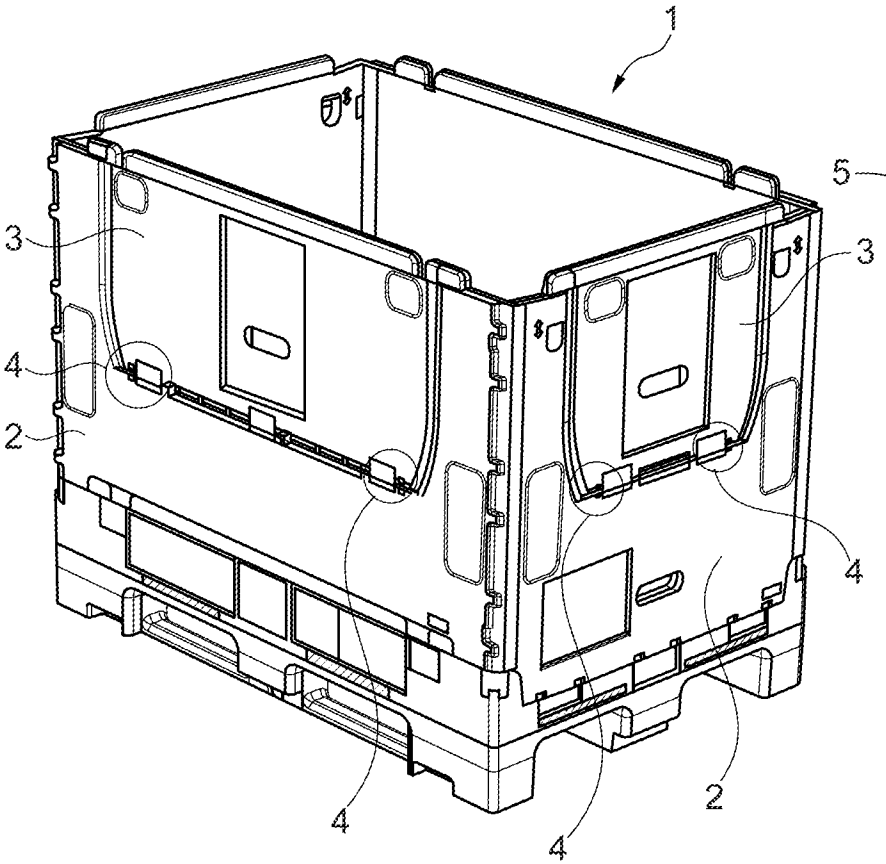

FIG. 1 shows a container 1 according to a preferred embodiment of the disclosure. The container 1 has a bottom wall and four side walls 2 serving as a first container portion and extending upwards from, preferably orthogonally to, the bottom wall. The bottom wall may form a receiving structure for a fork of a forklift. Each side wall 2 may be connected to a door 3 serving as a second container portion and being hinged to the corresponding side wall 2 via an articulation device 4. In this example, each door 3 has a lower rim, wherein one articulation device 4 is provided at each lower corner of the door 3. A shape and dimensioning of the door 3 corresponds to that of an opening 5 formed in the respective side wall 2, as shown in FIG. 2.

In FIG. 1, the doors 3 of the container 1 are closed and locked and cover the openings 5, such that an upper rim of the side wall 2 is flush with an upper rim of the door 3. The upper rims of the doors 3 may form a portion of a stacking rim adapted for engagement with a corresponding stacking portion of a bottom wall of a corresponding second container. In FIG. 2, the doors 3 are fully opened, such that the doors 3 are folded downwards and are essentially adjacent and parallel to the side walls 2.

Figure 3:
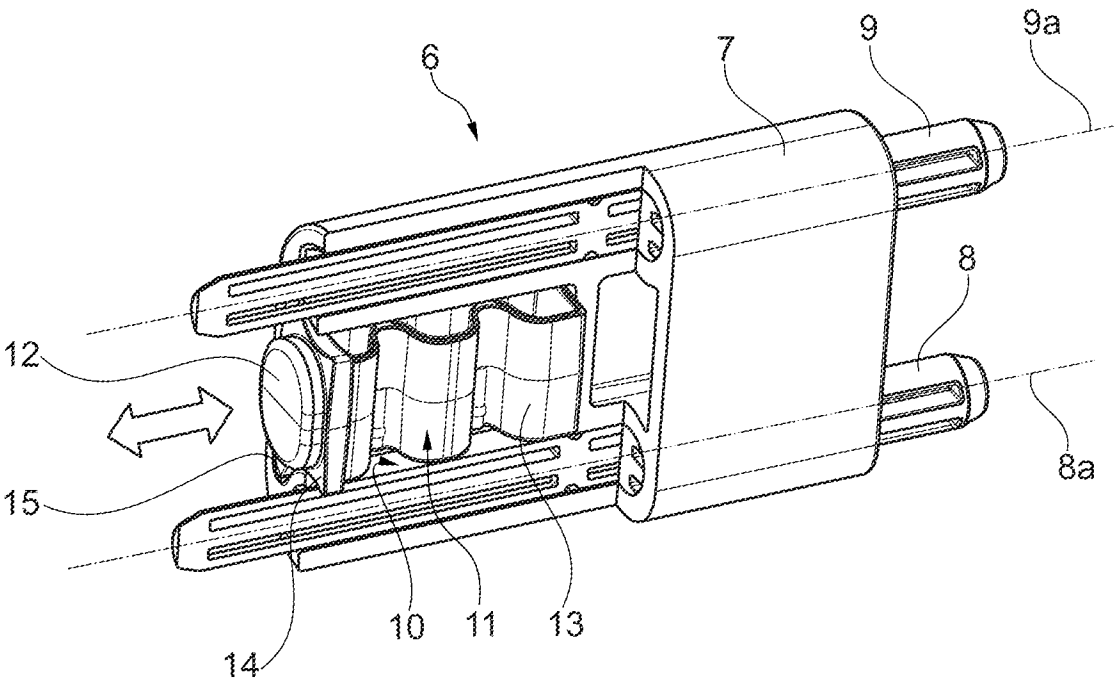
FIG. 3 shows a partially sectional view of an intermediate element of an articulation device of the container according to the preferred embodiment.

FIG. 3 shows a partially sectional view of an intermediate element 6 of the articulation device 4 of the container 1. The intermediate element 6 has a main body 7 having an essentially oval cross-section. At a first rounded end of the oval cross-section, the main body 7 accommodates a first hinge pin 8 defining a first hinge axis 8*a* and protruding from the main body 7 for insertion into a first hinge eye formed by the side wall 2. Further, at a second rounded end of the oval cross-section, the main body 7 accommodates a second hinge pin 9 defining a second hinge axis 9*a* and protruding form the main body for insertion into a second hinge eye formed by the door 3. The first and second hinge axis 8*a*, 9*a* extend parallel to each other.

Figure 4:
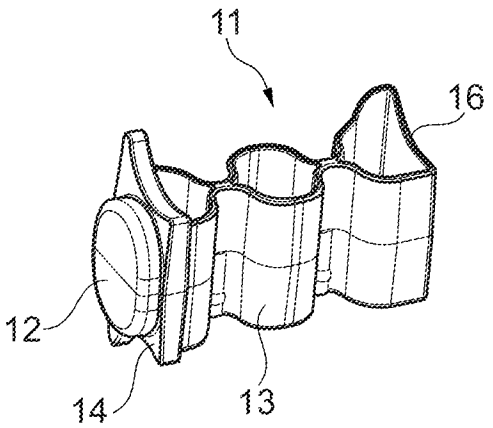
FIG. 4 shows a blocking element and a spring element of the intermediate element shown in FIG. 3.

Between the first and second hinge axis 8*a*, 9*a*, the main body forms a recess 10 or pocket. In said recess 10, a blocking element 11 is accommodated. The blocking element 11, also shown in FIG. 4, has an outer blocking end portion 12 adapted to protrude from the recess 10 in a blocking position shown in FIG. 3. The blocking end portion 12 forms an essentially oval nub. Further, the blocking element 11 has an inner spring portion 13 accommodated in the recess 10. The spring portion 13 is compressible in the extending direction or depth direction of the recess 10 to bias the blocking end portion 12 towards the protruding blocking position. Further, the spring portion 13 may be formed from two plastic sheets, which alternatingly contact each other and open to form an O-shape or diamond shape between such contact portions. Surrounding the blocking end portion 12, a collar 14 may be formed which has a shape essentially corresponding to a shape of the opening 15 of the recess. The blocking end portion 12 extends further outwards with respect to the main body 7 than the collar 14. The blocking end portion 12, the spring portion 13 and preferably the collar 14 are formed integrally. Dimensions and shape of an inner end 16 of the spring portion 13 may correspond to a cross-section of the recess 10 such that the inner end of the spring portion 13 is held at a defined position within the recess 10.

Figure 5:
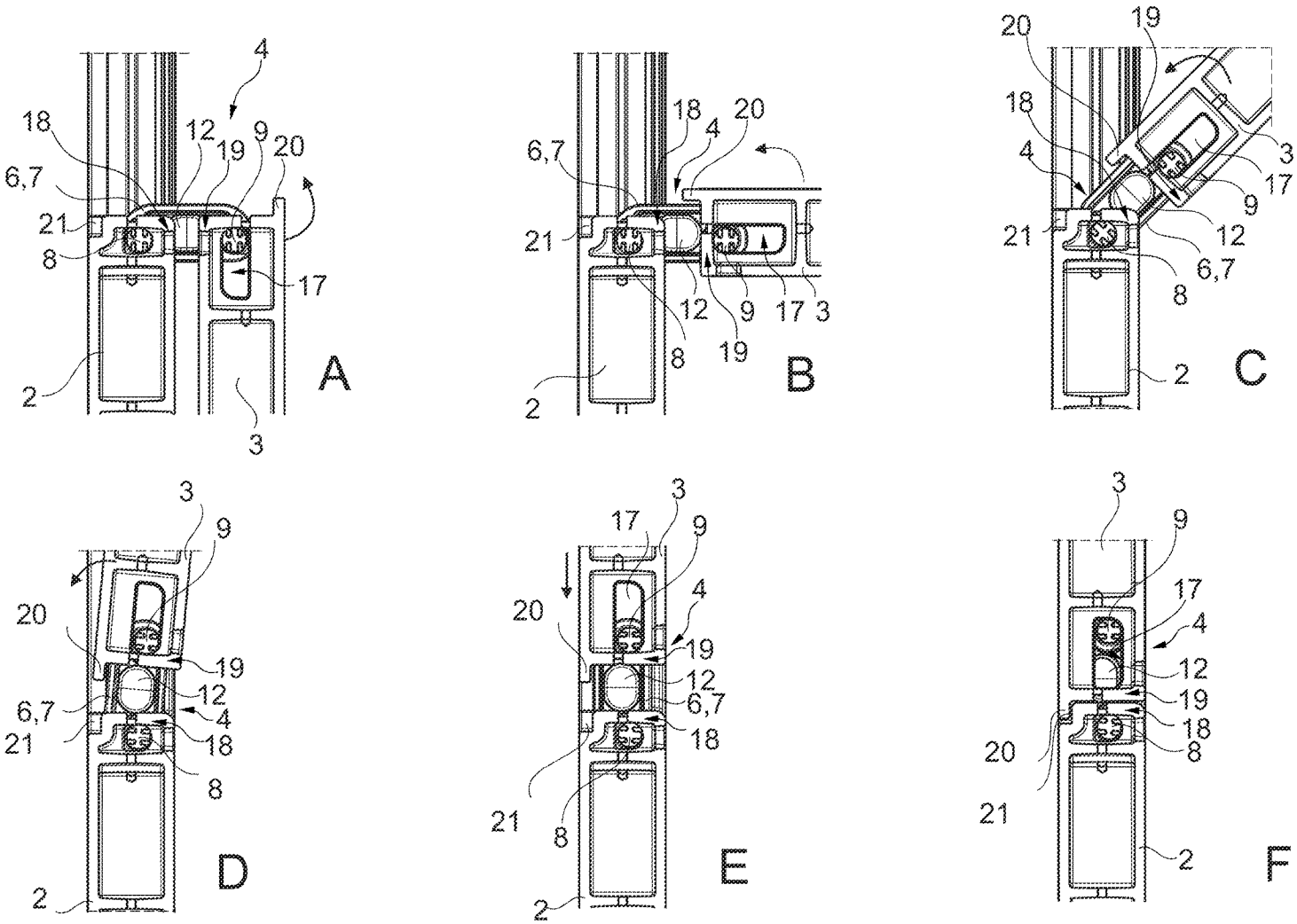
FIG. 5 illustrates a closing process of the door of the container according to the preferred embodiment.

FIG. 5 illustrates a closing process of the door 3 of the container 1 according to the preferred embodiment via views A (on the left) to F (on the right). In a first view A, the door 3 is in a fully opened position as shown in FIG. 2. The door 3 is folded downwards (towards the bottom wall) and extends essentially parallel and adjacent to the side wall 2. The intermediate element 6 which connects the side wall 2 and the door 3 extend preferably orthogonally thereto, providing a distance between the first hinge pin 8 and the second hinge pin 9.

As can be seen in view A, the first hinge pin 8 is received in a round hinge eye of the side wall which does not allow a translational movement of the first hinge pin 8 with respect to the side wall 2. The second hinge pin 9, however, is received in a longitudinally extending hinge eye forming a guiding groove 17 or guiding slot for guiding the second hinge pin 9 to move transverse to the first and second hinge axis 8*a*, 9*a*. Thus, the guiding groove 17 and the second hinge pin 9 form a sliding joint. In the fully opened position, the door 3 hangs from the second hinge pin 9, such that said second hinge pin 9 is located at a lower end (with respect to a closed position of the door 3) of the guiding groove 17 or guiding slot. Further, in this fully opened position and viewed in the present sectional view of the side wall 2 and door 3, the blocking end portion 12 of the blocking element 11 overlaps with one container outwards facing side (first unblocking part) of a first edge portion 18 of the side wall 2 and one container outwards facing side (second unblocking part) of a second edge portion 19 of the door 2, such that the blocking element 11 is held pushed into the recess 10 with the spring portion 13 (not shown in FIG. 5) being biased. I.e., the blocking element 11 is in an unblocking position. In particular, this view shows that a distances between the hinge eyes with respect to the corresponding container outer sides (unblocking parts) of the first and second edge portions 18, 19 is larger than a distance between the locking end portion 12 and the first and second hinge pins 8, 9.

Form the fully opened position shown in view A, the door 3 is pivoted upwards around the second hinge pin 9 and the second hinge axis 9*a* to an intermediate position shown in view B, as illustrated by an arrow. Said pivoting is limited by a stop formed between a protruding inner wall portion 20 forming a second engagement portion and a surface of the intermediate element 6. In this manner, the intermediate element 6 and the door are aligned with each other and are preferably orthogonal with respect to the side wall 2. The second hinge pin 9 is still located at the lower end of the guiding groove 17.

Due to the pivoting of the door 3, the second unblocking part of the second edge portion 19 has pivoted away from the blocking end portion 12, such that an upper end (with respect to a closed position of the door 3) of the blocking end portion 19 is released and may protrude from the recess into a space formed between the side wall 2 and the door 3. Essentially, in the intermediate position shown in view B, a lower rim of the guiding groove 17 (i.e. a second blocking part of the second edge portion 19 formed by a rim of the door 3 facing downwards, when the door 3 is closed) is sandwiched or inserted between the second guiding pin 9 and the upper end of the blocking end portion 12 such that the second guiding pin 9 cannot move in the guiding groove 17 and the sliding joint is blocked. Further, the blocking end portion 12 provides an obstacle, particularly supporting the door 3 in the lifted position, or in other words, impeding the door 3 from pivoting back into the fully opened position.

Figure 6:
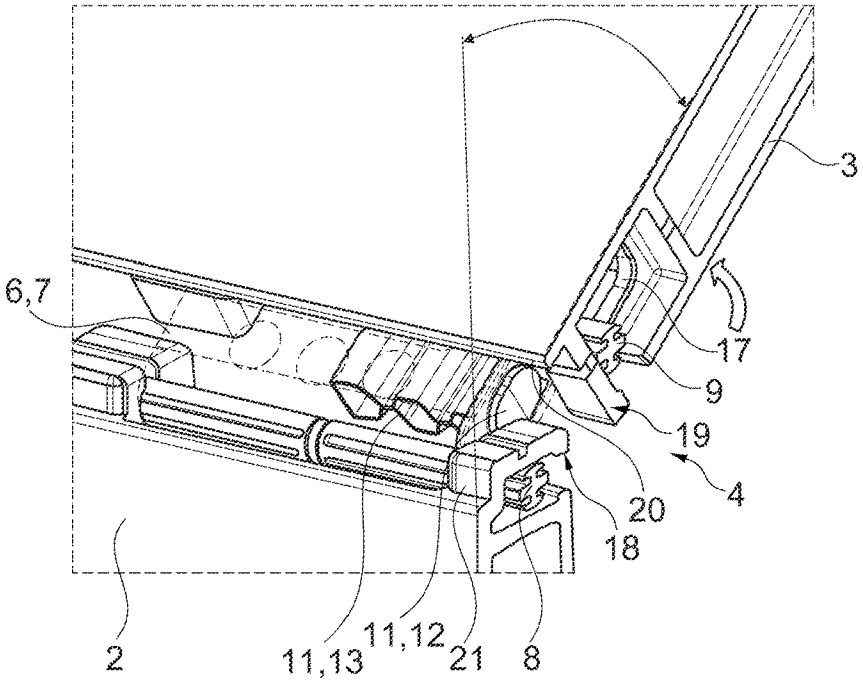

Since a relative position of the intermediate element 6 and the side wall 2 has not changed, the lower end of the blocking end portion 12 and the blocking element 11 are still pushed into the recess 10 by the first edge portion 18 of the side wall 2. I.e. the blocking end portion 12 is tilted with respect to a surface of the intermediate element 6 wherein the opening 15 of the recess 10 is formed, such that the blocking end portion 12 defines an inclined surface at a contact area $C_2$. When the door 3 is rotated further around the second hinge axis 9*a* towards the closing position as shown in FIG. 5, view C and in FIGS. 6 and 7, the first edge portion 18 (the unblocking part thereof which includes a corner of the door 3) first slides along the lower end of the blocking end portion 12 but does not release the blocking element 11. Thus, the tilted position of the blocking end portion 12 and the blocked position of the sliding joint are maintained. Due to the sliding joint being blocked by the blocking end portion 12, the door 3 does not slide downwards along the guiding groove 17.

Figure 7:
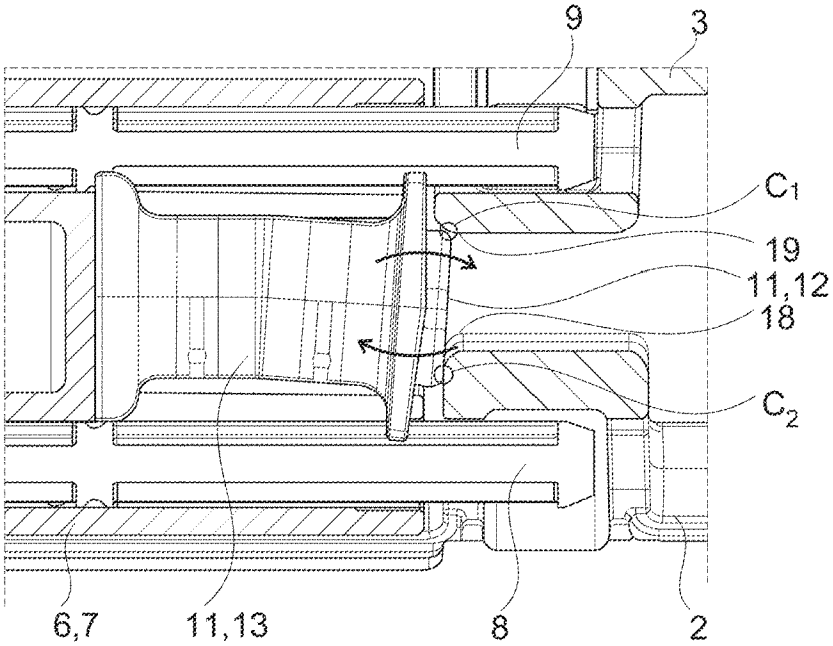
FIGS. 6 and 7 show the portion of the container shown in FIG. 6 from a container inside, illustrating a tilting of the blocking element at a certain closing angle of the door.

The tilting of the blocking end portion 12 is best seen in FIG. 7, where arrows illustrate said tilting and where the articulation device 4 is viewed from an inside of the container 1. Further, FIG. 7 shows a supporting contact C1 between a circumferential surface of one part of the blocking end portion 12, which protrudes from the recess 10, and the door 3 (its adjacent edge portion adjacent to the second edge portion 19), where the door 3 is supported in the extended/unlocked position, rolling off on the circumferential surface of the blocking end portion 12. Further, a blocking contact C2 is shown between a (outer) front surface of another part of the blocking end portion 12 and the first edge portion 18 of the side wall 2, where the side wall 2 contacts the blocking end portion 12 to keep it pushed into the recess 10.

When the door 3 is rotated further, shortly before reaching the closing position (e.g. 2° to 10° of pivoting from the closing position) as shown in FIG. 5, view D, the first edge portion 18 (the first unblocking part thereof) of the side door 2 moves away from the lower end of the blocking end portion 12, releasing it. Accordingly, the blocking end portion 12 is pushed out fully of the recess 10 due to the spring portion 13 of the blocking element 11. In this position, an upper rim of the first hinge eye (i.e. a first blocking part of the first edge portion 18), is sandwiched between the blocking end portion 12 an the first hinge pin 8. Thus, the blocking end portion 12 forms a support for the intermediate element 6 with respect to the first container portion 2, or in other words, an obstacle, impeding the intermediate element 6 from pivoting back towards the intermediate position and the fully opened position. In particular, this view shows that distances between the hinge eyes with respect to the lower end of the door 3 and, respectively, the upwards facing side of the lower rim of the opening 5 (i.e. the first and second blocking parts) is essential equal to or smaller than corresponding distances between the locking end portion 12 and the first and second hinge pins 8, 9.

Figure 9:
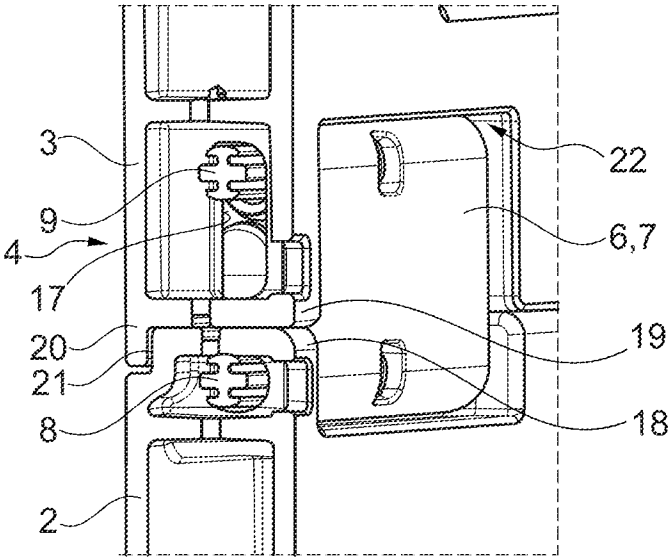
FIGS. 8 and 9 show a portion of the container according to the preferred embodiment from an outer side of the container, respectively illustrating the articulation device directly before reaching a closing position and after locking the door.
Figure 8:
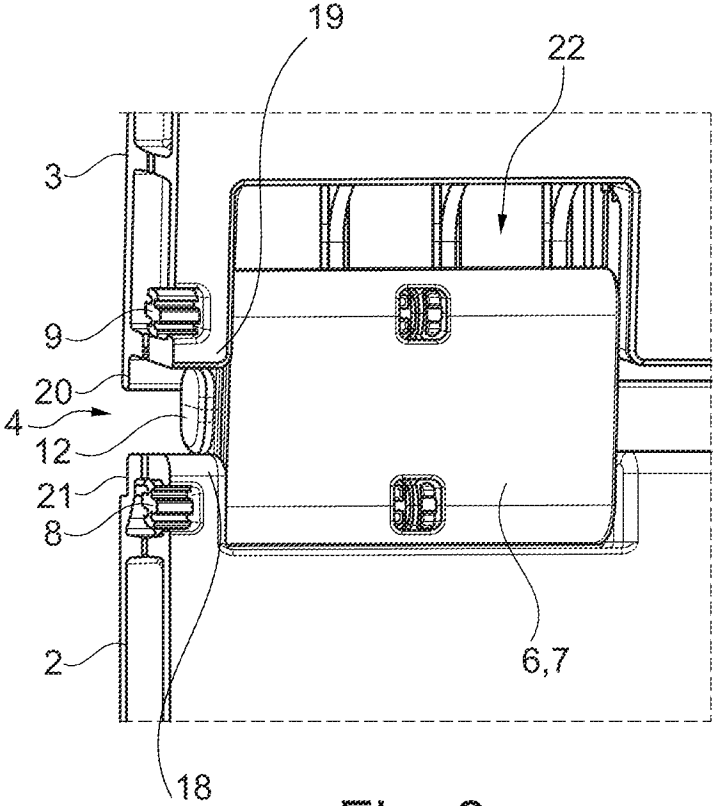

Finally, when the door 3 reaches the closing position as shown in FIG. 5, view E, and FIG. 8, the door is pushed downwards as illustrated by an arrow. In this closing position, the protruding inner door portion 20 and a recessed inner wall portion 21 are aligned. Also, FIG. 8, which shows the articulation device 4 from an outer side of the container 1, further shows that the door 3 forms a pocket 22 having at height corresponding to at least a length of the guide groove 17 and being located and dimensioned to receive the intermediate element 6. Then, due to a lower rim of the door 3 pressing against the blocking end portion 12, the blocking element 11 is pushed back into the recess 20, such that the sliding joint is unblocked. Accordingly, due to the pushing down by the lower rim of the door and the weight of the door, said door slides along the sliding joint into a locked position shown in FIG. 5, view F, and FIG. 9. During this step of actuating the sliding joint, the protruding inner door portion 20 and the recessed inner wall portion 21 engage with each other to lock the door 3 relative to the side wall 2 in the closed position. FIG. 9, which shows the articulation device 4 from the outer side of the container 1, further shows that in the locked position, the door 3 has slid towards the lower rim of the opening 5 such that main body 7 of the intermediate element 6 essentially fills the pocket 22.

The invention claimed is:

1. A container comprising:

a first container portion;

a second container portion; and an articulation device connecting the first container portion to the second container portion to be pivotable around a first hinge axis and comprising a sliding joint, which allows a sliding of the second container portion relative to the first container portion transverse to the first hinge axis, wherein the articulation device comprises an intermediate element, wherein the intermediate element is connected to the first container portion to be rotatable around the first hinge axis, wherein the intermediate element is connected to the second container portion to be rotatable around a second hinge axis, and wherein the articulation device comprises a blocking element, which is movable from a blocking position, blocking the sliding joint, against a spring force of the blocking element to an unblocking position, unblocking the sliding joint, by an actuation of said sliding joint.

2. The container according to claim 1, wherein the first hinge axis is essentially parallel to a bottom wall of the container.

3. The container according to claim 1, wherein the blocking element is a separate member.

4. The container according to claim 1, further comprising an opening, wherein the second container portion is pivotable between a closing position to cover or close the opening and a fully opened position, and the first container portion has a first engagement portion and the second container portion has a second engagement portion, which are configured to engage or disengage by actuating the sliding joint when the second container portion is in the closing position.

5. The container according to claim 1, wherein the blocking element is accommodated in a recess within the articulation device, such that the blocking element is adapted to protrude from said recess in the blocking position to block the sliding joint.

6. The container according to claim 1, wherein, by actuating the sliding joint when the blocking element is in the blocking position, the second container portion and/or the first container portion is pressed against the blocking element and pushes said blocking element into the unblocking position.

7. The container according to claim 6, wherein an inclined surface is provided at a contact area where the blocking element contacts the first container portion and/or the second container portion, such that a force acting on the blocking element in a sliding direction of the sliding joint due to a pressure of the first container portion and/or the second container portion is redirected via the inclined surface to push the blocking element into the unblocking position.

8. The container according to claim 1, wherein the first container portion has a first edge portion which is a corner or a protrusion extending radially with respect to the first hinge axis, and the blocking element is maintained pushed into the recess by the first edge portion, when the second container portion is a fully opened position, and when the intermediate element of the articulation device is rotated towards the closing position around the first hinge axis, the blocking element is at least partially released by said first edge portion to protrude from the recess.

9. The container according to claim 5, wherein the second container portion has a second edge portion which is a corner or a protrusion extending radially with respect to the second hinge axis, and the blocking element is maintained pushed into the recess by the second edge portion, when the second container portion is a fully opened position, and when the second container portion is pivoted towards the closing position around the second hinge axis, the second edge portion is removed from the blocking element, such that said blocking element is at least partially released to protrude from the recess.

10. The container according to claim 5, wherein the recess opens in a surface of the intermediate element and the blocking element is tiltable relative to said surface of the intermediate element.

11. The container according to claim 1, wherein the second container portion forms a stop with the articulation device and/or with the first container portion, said stop limiting a pivoting of the second container portion around the second hinge axis towards the closing position.

12. The container according to claim 11, wherein a second engagement portion forms the stop with the articulation device and/or with the first container portion.

13. The container according to claim 1, wherein the blocking element has a blocking end portion for blocking the sliding joint and a spring portion providing the spring force, wherein the spring portion and the blocking end portion are formed integrally.

14. The container according to claim 13, wherein the blocking end portion is smaller than an opening of the recess and a collar having a same shape as the opening of the recess is formed surrounding the blocking end portion.

15. An articulation device for a container according to claim 1, the articulation device comprising:

the first hinge axis, adapted to provide a pivotable connection of the first container portion to the second container portion;

the sliding joint, which allows a sliding of the second container portion relative to the first container portion transverse to the first hinge axis; and the blocking element, which is movable from a blocking position, blocking the sliding joint, against the spring force to an unblocking position, unblocking the sliding joint, by an actuation of said sliding joint.

16. A container comprising:

a first container portion;

a second container portion;

an articulation device connecting the first container portion to the second container portion to be pivotable around a first hinge axis and comprising a sliding joint, which allows a sliding of the second container portion relative to the first container portion transverse to the first hinge axis; and a blocking element, which is movable from a blocking position, blocking the sliding joint, against a spring force of the blocking element to an unblocking position, unblocking the sliding joint, by an actuation of said sliding joint;

wherein:

the blocking element is accommodated in a recess within the articulation device, such that the blocking element is adapted to protrude from said recess in the blocking position to block the sliding joint, the second container portion has a second edge portion which is a corner or a protrusion extending radially with respect to the second hinge axis, the blocking element is maintained pushed into the recess by the second edge portion, when the second container portion is a fully opened position, and when the second container portion is pivoted towards the closing position around the second hinge axis, the second edge portion is removed from the blocking element, such that said blocking element is at least partially released to protrude from the recess.

17. A container comprising:

a first container portion;

a second container portion;

an articulation device connecting the first container portion to the second container portion to be pivotable around a first hinge axis and comprising a sliding joint, which allows a sliding of the second container portion relative to the first container portion transverse to the first hinge axis; and a blocking element, which is movable from a blocking position, blocking the sliding joint, against a spring force of the blocking element to an unblocking position, unblocking the sliding joint, by an actuation of said sliding joint;

wherein the blocking element has a blocking end portion for blocking the sliding joint and a spring portion providing the spring force, wherein the spring portion and the blocking end portion are formed integrally.

* * * * *